US006603948B2

(12) United States Patent
Payne et al.

(10) Patent No.: US 6,603,948 B2
(45) Date of Patent: Aug. 5, 2003

(54) RADIO FREQUENCY TONER FUSING

(75) Inventors: David M. Payne, Star, ID (US); Richard L. Payne, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/992,853

(22) Filed: Nov. 6, 2001

(65) Prior Publication Data

US 2003/0086734 A1 May 8, 2003

(51) Int. Cl.[7] ..... G03G 15/20
(52) U.S. Cl. ..... 399/336; 219/216
(58) Field of Search ..... 399/320, 328, 399/330, 331, 335–338; 219/216, 469, 470; 432/60

(56) References Cited

U.S. PATENT DOCUMENTS 4,399,341 A * 8/1983 Yasuoka ..... 399/336 X
4,435,072 A * 3/1984 Adachi et al. ..... 219/216 X
4,456,368 A * 6/1984 Isaka et al. ..... 219/216 X
4,461,823 A 7/1984 Held
4,482,239 A * 11/1984 Hosono et al. ..... 219/216 X
4,511,778 A * 4/1985 Takahashi et al. ..... 399/336 X
4,542,980 A * 9/1985 Tajima ..... 219/216 X
5,212,526 A 5/1993 Domoto et al.
5,232,812 A 8/1993 Morrison et al.
5,250,387 A 10/1993 Held et al.
5,275,918 A 1/1994 Held et al.
5,905,012 A 5/1999 De Meutter et al.
6,087,641 A * 7/2000 Kinouchi et al. ..... 399/330 X

* cited by examiner

*Primary Examiner*—William J. Royer

(57) ABSTRACT

A method and apparatus for fusing toner to a laser printed page. The apparatus includes a printing medium transport system and a radio frequency antenna for imparting energy to the toner to fuse the toner to the page. The apparatus facilitates faster print speeds and lower energy consumption than conventional laser printers that require heating elements to fuse the toner to the page.

26 Claims, 4 Drawing Sheets

RADIO FREQUENCY TONER FUSING

TECHNICAL FIELD

The present invention relates to printing, and more particularly to the process of fusing toner to paper.

BACKGROUND

Modern laser printing is generally accomplished by what is commonly known as an imaging process. At the heart of the imaging process is an organic photoconductive (OPC) drum. The drum typically includes an extruded aluminum cylinder coated with a non-toxic organic photoconductive material. There are six generalized stages to the electrophotographic process: cleaning, conditioning, writing, developing, transferring and fixing.

Cleaning is the first stage in the electrophotographic process. This stage prepares the OPC drum to receive a new latent image by applying a physical and electrical cleaning process. The physical cleaning of the OPC drum is typically accomplished by a drum cleaning blade (or wiper blade) and a recovery blade. The wiper blade scrapes any excess toner from the drum and the recovery blade catches the toner and sweeps it into a waste hopper. In the electrical aspect of cleaning, the previous image on the drum must be cleared before a new one may be applied. The electrical cleaning of the OPC drum is performed by erasure lamps (usually corona wire technology) or a primary charge roller (PCR), which eliminate the previous latent image from the drum.

After the drum has been cleaned, it must be conditioned or charged to accept an image from a laser. A primary corotron (corona wire or PCR) applies a uniform negative charge (usually in the range of −600 V to −720 V DC) to the surface of the drum.

Following the conditioning stage is the writing stage. In this stage, a laser beam is used to discharge a conditioned charge to the drum surface. The conditioned charge creates a latent image on the drum. An aluminum base is connected to an electrical ground and the photoconductive material comprising the OPC drum becomes electrically conductive to ground when exposed to light (generally a laser). Therefore, the negative charges deposited onto the surface of the drum conduct to the aluminum base when exposed to light, creating the latent image. The latent image area will attract toner in a later stage.

The fourth stage is developing. At this stage, the latent image becomes a visible image. This stage generally requires four major components: toner particles, a developer roller assembly, a metering blade, and an AC/DC charge. The toner particles are attracted to the developer roller either by an internal magnet or by an electro-static charge. The developer roller carries the toner particles to a metering blade (a/k/a a doctor blade), where the toner particles tumble and create a tribo-electric charge (friction) on the surface of the toner particles. The metering blade then provides for an evenly distributed amount of toner particles to pass to the OPC drum. Once the toner particles have passed beyond the doctor blade, it is ready to be presented to the OPC drum. The developer roller is then charged with an AC/DC charge from a High Voltage Power Supply. This charge allows the toner particles to "jump" from the developer roller and travel to the OPC drum where it is attracted to the latent image.

At this point, the toner image on the drum is transferred onto a sheet of paper. As the paper is passed under the OPC drum, it is passing over a transfer corotron assembly. The transfer corotron assembly places a positive charge on the back of the page, thus attracting the toner from the drum.

The sixth and final stage is fixing. Also known as fusing, this is the stage in which the toner is permanently affixed to the paper. A fuser assembly typically includes a heated roller, a pressure roller, a heating element, a thermistor, a thermal fuse, and, sometimes, a cleaning pad. The heating element is typically placed inside the heated roller, which is usually constructed of aluminum with a teflon coating. The heated roller is heated to approximately 355° F. (180° C.). The pressure roller (second roller) is usually a rigid foamed silicon rubber. This second roller applies pressure to the heated roller. The paper passes between the two rollers and the heated roller melts the toner particles while the pressure roller presses the toner into the fiber weave of the paper.

As laser printing technology has evolved, one of the primary focal points is printing speed. There is a constant demand for higher print speeds. However, as print speed increases, the power required for the fixing or fusing stage becomes greater, as the toner requires a certain amount of energy to melt and fuse to the paper. Current fusing technology has thus come to a speed "ceiling," where faster print speeds may require printers to have dedicated thirty-amp circuits to provide the necessary power to the heating element to keep up with the high print speeds. As speed demands continue to rise, the heating element power requirements to fuse the toner have become prohibitive. In addition, it has been a constant problem to apply an even heating distribution to the heated roller and the toner, leading to poorly fused images.

Further, during times when the printer is not in use, generally the user prefers that the printer, and especially the high energy absorbing heating element, revert to a low power or "sleep" mode. However, when the user does have a need to print either while the printer is in sleep mode or when the printer has been turned off completely, it generally takes significant time for the heating element to warm up before the printer is operational. In addition, the use of heating elements introduces other deleterious effects, usually necessitating the use of cooling apparatus to keep components that may be heat sensitive from overheating. Often the use of fans is necessary--adding again to the power requirements and creating unwanted noise.

U.S. Pat. No. 5,212,526 ('526) discusses an alternative to the conventional fusing process by introducing an apparatus for simultaneously transferring and fusing a toner solute in a UV-curable solution. However, the apparatus taught by the '526 patent utilizes a large belt to advance the page, and this large belt is very specialized and expensive. The large belt taught by the '526 patent must be a photoreceptor and also must be capable of transmitting UV rays—capabilities that at present are very expensive to provide.

U.S. Pat. No. 5,232,812 ('812) discloses another alternative process for fusing an image. However, the process disclosed by the '812 patent involves applying a separate layer of UV-curable liquid over the toner and does not cure the toner itself

SUMMARY OF SELECTED EMBODIMENTS

In accordance with one aspect of the present invention, there is disclosed an apparatus including a print medium transport system and a first radio frequency energy emitting antenna for fusing toner to a print medium.

The apparatus may further include a print medium arranged adjacent the antenna, and toner disposed on the print medium. An oscillator may be coupled to the antenna and adapted to operate within the microwave range.

According to this aspect, the antenna may define a waveguide, the wave-guide being shaped to focus the radio frequency energy emitted from the antenna to at least a portion of a line of an image or at least a portion of a line of text on the print medium.

In accordance with one aspect of the present invention, there is a second antenna, the first and second antennae being arranged on opposing sides of the print medium and providing a high frequency electromagnetic field thereacross. The first and second antennae may be arranged in a roller configuration, and the first and second antennae may apply contact pressure to the print medium as the print medium passes therebetween.

In accordance with one aspect of the invention, the print medium is paper.

In accordance with one aspect of the invention, the oscillator is adjusted to a frequency within 10% of a natural frequency of the toner.

In accordance with one aspect of the invention, there is described a method of fusing toner to a page, the method including the steps of passing the page by a radio frequency antenna and imparting electromagnetic energy to the toner on the page. According to this method, the radio frequency antenna may oscillate within 10% of a natural frequency of the toner, or the radio frequency antenna may oscillate within 1 MHz of the natural frequency of the toner. The electromagnetic energy imparted to the page is sufficient to raise the temperature of the toner to the toner melting point.

In one aspect of the present invention there is a printing apparatus including a photosensitive drum, a laser optic system for tracing an image on the photosensitive drum, a toner supply electrically charged opposite of the image traced on the photosensitive drum, and a radio frequency antenna for imparting electromagnetic energy to the toner.

In accordance with one aspect of the invention, there is disclosed a method of printing an image on a page by an electrophotographic process, the method including the steps of cleaning an organic photoconductive (OPC) drum, conditioning the OPC drum to accept an image from a laser, writing a latent image on the OPC drum with a laser beam, developing the latent image into a toner image by attracting toner to the OPC drum, transferring the toner to the page, and fusing the toner to the page by applying radio frequency energy to the toner. According to this method, there may be included the additional step of applying pressure to the toner and page substantially concurrent with the application of radio frequency energy to the toner.

BRIEF DESCRIPTION OF THE DRAWINGS

The foregoing and other features and aspects of the invention will become further apparent upon reading the following detailed description and upon reference to the drawings in which.

Figure 1:
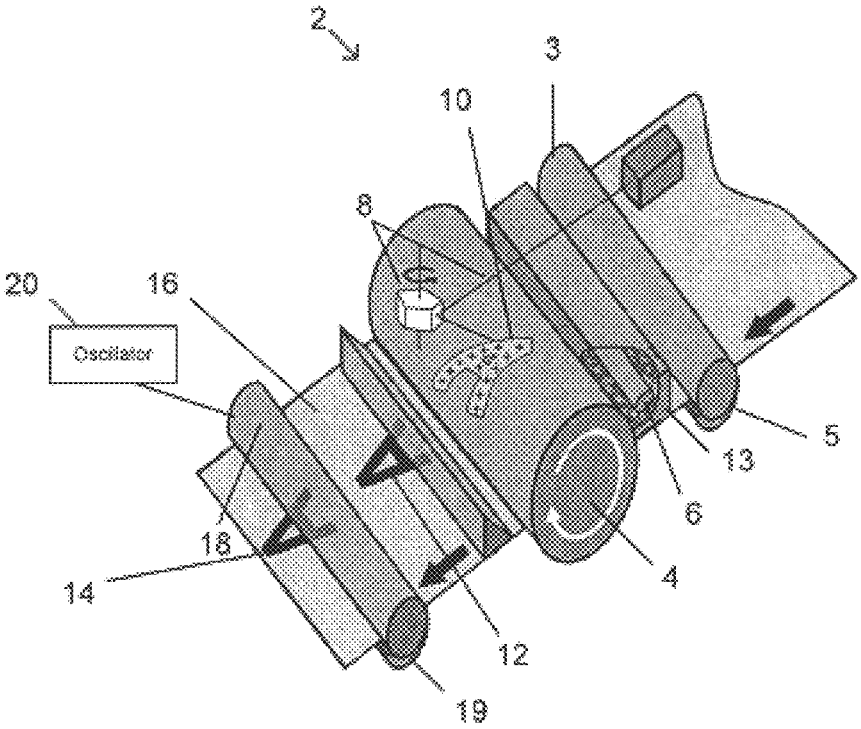
FIG. 1 is a laser printing apparatus according to one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SELECTED EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Turning now to the drawings, and in particular to FIG. 1, one embodiment of a laser printing apparatus (2) is shown. Laser printing apparatus (2) may include one or more photosensitive drums, for example organic photoconductive drum (4). Photoconductive drum (4) is readily available from a variety of commercial sources. Laser printing apparatus (2) may also include a charging member, for example a corona wire (not shown), for applying a negative charge to photoconductive drum (4). Laser printing apparatus (2) may further include a laser optic system (8). Laser optic system (8) may be used to write a latent image (10) on photoconductive drum (4). As described in the background section of this disclosure, latent image (10) may be developed by attracting toner (12) to photoconductive drum (4). Toner (12) from a supply (13) of toner may be positively charged by a charge roller (6). A developed image (14) may be transferred to a print medium or page, for example paper (16). However, it will be understood by those of skill in the art with the benefit of this disclosure that the print medium or page may be a transparency, slide, cardstock, construction paper, vinyl, or other page, and not limited to paper. Toner (12), which is arranged as developed image (14), may then be fused to paper (16) by the application of radio frequency (RF) energy transmitted from an RF antenna, for example first and second RF antennae (18) and (19). It will be understood that in some embodiments there may be only a first RF antenna (18). Laser printing apparatus (2) may also include a print medium transport system, for example rollers (3) and (5), for conveying paper (16) through the laser printing apparatus.

It will be recognized by those of skill in the art with the benefit of this disclosure that radio frequency energy is electromagnetic radiation comprising waves of electric and magnetic energy moving together (i.e., radiating) through space at the speed of light. Taken together, all forms of electromagnetic energy are referred to as the electromagnetic "spectrum." Radio waves and microwaves emitted by transmitting antennas are one form of electromagnetic energy. They are collectively referred to as "radio frequency" or "RF" energy or radiation. The term "electromagnetic field" or "radio frequency field" may be used to indicate the presence of electromagnetic or RF energy.

The RF waves emanating from RF antenna (18) are generated by the movement of electrical charges in the RF antenna (18) as induced by an oscillator (20). Electromagnetic waves may be characterized by a wavelength and a frequency. The wavelength is the distance covered by one complete cycle of the electromagnetic wave, while the frequency is the number of electromagnetic waves passing a given point in one second. The frequency of an RF signal is usually expressed in terms of a unit called the "hertz" (Hz). One Hz equals one cycle per second. One megahertz (MHz) equals one million cycles per second.

Different forms of electromagnetic energy are categorized by their wavelengths and frequencies. The RF part of the electromagnetic spectrum is generally defined as that part of the spectrum where electromagnetic waves have frequencies in the range of about three kilohertz (3 kHz) to three hundred gigahertz (300 GHz). Therefore, for purposes of this disclosure, RF energy is defined to be in the range of three kHz to three hundred GHz. Microwaves are a specific category of radio frequency waves that will be defined as radio frequency energy where frequencies range from several hundred MHz to several GHz.

First RF antenna (18) may be operatively connected to an oscillator, for example oscillator (20). Oscillators are commercially available from a myriad of sources. In some embodiments of the present invention, oscillator (20) is further defined to be a microwave oscillator, which is a subset of RF.

Figure 2:
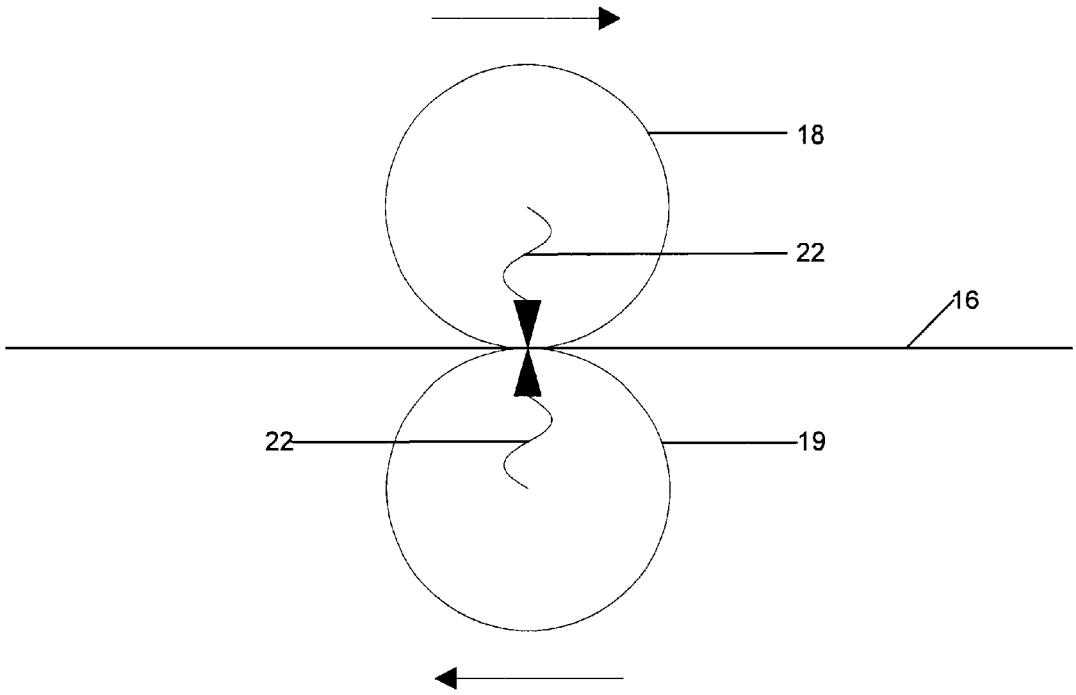
FIG. 2 is a side view of a pair of RF rollers according to one embodiment of the present invention.

First RF antenna (18), in combination with oscillator (20), provides RF energy used in the present invention to fuse toner (12) to paper (16). In one embodiment shown in FIG. 2, RF energy waves are symbolized by arrows (22). FIG. 2 shows a side view detail of first and second RF antennae (18) and (19). In the embodiment shown, RF antennae (18) and (19) are rollers. In a conventional laser printing apparatus, fusing rollers comprise a heating and pressure element to melt toner (12) and fuse the toner to paper (16). However, as disclosed in FIGS. 1–2, the rollers advantageously comprise RF antennae (18) and (19) without a heating element. Thus, the elimination of the heating element and cooling equipment is enabled by introducing RF antennae (18) and (19)—and therefore facilitated the reduction or elimination of the problems associated with warm up times, high-current requirements (although the RF antennae may also be added to conventional printing apparatus with heating elements), and fan noise. RF antennae (18) and (19) do not require warm up time to operate and may function with much less energy than a heating element. RF antennae (18) and (19) emit RF energy to toner (12) and thus the temperature of toner (12) is increased to at least the melting point of the toner (12). In the embodiment of FIG. 2, RF antennae (18) and (19) are arranged to impart pressure to toner (12) and paper (16) substantially concurrently with the application of RF energy as the paper passes through the roller/antennae to facilitate the fusion of toner (12) into the fiber weave of paper (16). As will be discussed below, the fusion of toner (12) to paper (16) may not require a pressure roller arrangement of RF antennae (18) and (19).

Similar to the tuning of microwave oven oscillators and antennae to closely match the natural frequency of water, RF antennae (18) and (19) and oscillator (20) may be tuned to closely match the natural frequency and/or wavelength of the toner (12). In some embodiments, the natural frequency of the toner (12) may be matched nearly identically by RF antennae (18) and (19), while in other embodiments the frequency of RF antennae (18) and (19) may be within one to twenty percent (±1%–20%) of the toner natural frequency. In some embodiments, the frequency of oscillator (20) and RF antennae (18) and (19) are tuned to within ten percent (±10%) of the natural frequency of the toner (12). In still other embodiments, the antennae frequency is tuned to within one megahertz (±1 MHz) of the toner natural frequency. It will be understood by those of skill of the art with the benefit of this disclosure that the determination of the natural toner frequency may require some effort and experimentation as toner products vary. However, it would nevertheless be a routine undertaking not requiring undue experimentation.

Likewise, the selection of proper RF antennae (18) and (19) and oscillator (20) to match the natural frequency and proper wavelength of the toner (12) would be a routine undertaking by the skilled artisan with the benefit of this disclosure. In addition, the RF power requirements and dwell time to impart sufficient energy to the toner (12) to invoke melting and/or fusing may vary from application to application depending on the toner (12). However, this determination would also constitute a routine undertaking without undue experimentation by the skilled artisan with the benefit of this disclosure. The application of RF energy by RF antennae (18) and (19) may advantageously be uniformly distributed to paper (16) without the problems of uneven distribution associated with heating elements. Further, because the RF oscillator may be tuned to match the natural frequency of the toner (12), only the toner (12) will be affected or heated by the application of the RF energy, greatly reducing the a mount of energy required to fuse t he toner (12). The energy reduction may be due—at least in part—to the fact that a conventional printing apparatus must heat the entire paper (16) and other components such as the rollers themselves.

Figure 3:
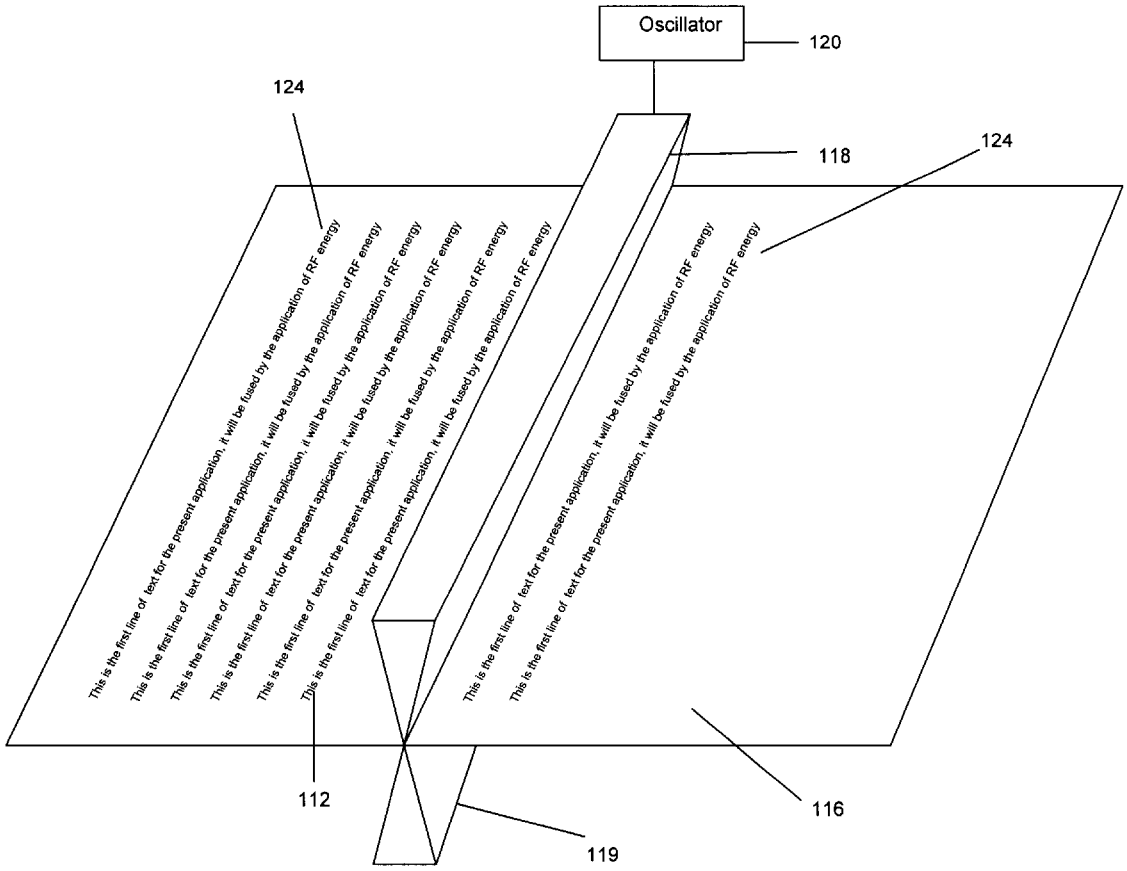
FIG. 3 is a perspective view of an RF antenna apparatus according to one embodiment of the present invention.

Referring next to FIG. 3, antennae (118) and (119) are connected to an oscillator (120) and may be arranged to act as RF wave guides. Antennae (118) and (119) may therefore be focused to impart RF energy along a specific line or effective nip width. In the embodiment shown, antennae (118) and (119) are shaped to focus the RF energy uniformly along the length of the antennae (118) and (119) a t approximately an effective nip width of 0.05 to 10.0 millimeters. However, the width of the antennae focus area may be varied to any effective nip width or any size line as desired. It is within the skill of the routineer with the benefit of this disclosure to appropriately size and shape antennae (118) and (119) to function as wave guides to fit the needs associated with a particular toner and/or printer. In the embodiment shown, as paper (116) passes by RF antennae (118) and (119), portions of the toner comprising lines of text (124) may be continuously fused as they advance along the antennae (118) and (119).

Figure 4:
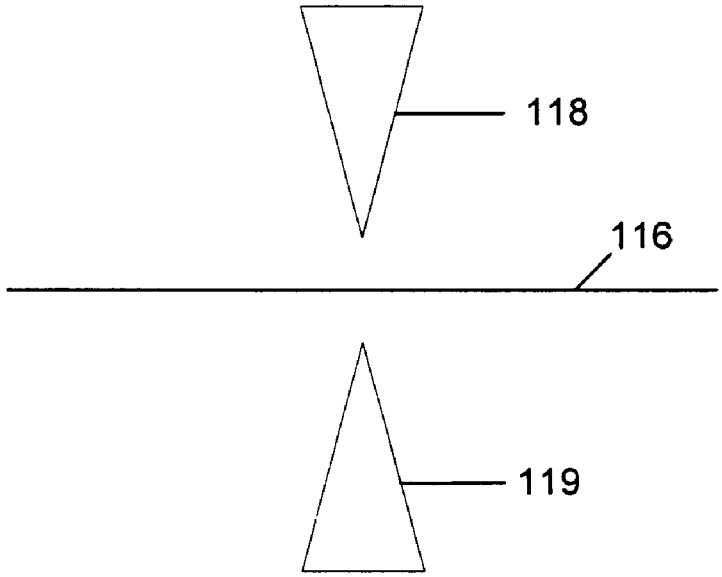
FIG. 4 is a side view of the RF antenna shown in FIG. 3.

As shown in FIG. 4, which is a side view of the RF fusing apparatus shown in FIG. 3, antennae (118) and (119) may not be in physical contact with paper (116). RF energy may be imparted to toner (112) without touching the paper (116). In the embodiment of FIGS. 3–4, toner (112) is fused to paper (116) by applying RF energy to melt the toner (112) to the paper (116). In this embodiment there is no pressure applied to the toner (112) to facilitate the fusion of the toner (112) to the paper (116).

Because the RF fusing apparatus may be turned off and on with no warm up time with focused RF energy, the present invention advantageously facilitates operating printers at faster speeds and/or reduced power.

While the present invention has been particularly shown and described with reference to particular illustrative embodiments thereof, it will be understood by those skilled in the art that various changes in form and details may be made without departing from the spirit and scope of the invention. The above-described embodiments are intended to be merely illustrative, and should not be considered as limiting the scope of the present invention.

What is claimed is:

1. An apparatus comprising:

a print medium transport system; and a first radio frequency energy emitting antenna for fusing toner to a print medium;

wherein the first radio frequency energy emitting antenna further comprises a wave guide, the wave guide being shaped to focus the radio frequency energy emitted from the first radio frequency energy emitting antenna onto said toner on said print medium at a specified effective nip width.

2. The apparatus of claim 1, further comprising an oscillator coupled to the first radio frequency energy emitting antenna.

3. The apparatus of claim 2, wherein the oscillator operates within the microwave range.

4. The apparatus of claim 1, wherein the wave guide is shaped to focus the radio frequency energy emitted from the first radio frequency energy emitting antenna to a line on the print medium.

5. An apparatus comprising:

a print medium transport system;

a first radio frequency energy emitting antenna for fusing toner to a print medium; and a second radio frequency antenna, the first and second antennae being arranged on opposing sides of the print medium and providing an electromagnetic field thereacross.

6. The apparatus of claim 5, wherein the first and second antennae are arranged in a roller configuration and wherein the first and second antennae apply contact pressure to the print medium as the print medium passes therebetween.

7. The apparatus of claim 5, wherein the print medium is paper.

8. The apparatus of claim 5, wherein radio frequency energy from the first radio frequency energy emitting antenna has a frequency within 20% of a natural frequency of the toner.

9. An apparatus comprising:

a print medium transport system; and a first radio frequency energy emitting antenna for fusing toner to a print medium;

wherein radio frequency energy from the first radio frequency energy emitting antenna has a frequency within 20% of a natural frequency of the toner.

10. The apparatus of claim 9, wherein the first radio frequency energy emitting antenna is adjusted to a frequency within 10% of a natural frequency of the toner.

11. The apparatus of claim 9, wherein the first radio frequency energy emitting antenna further comprises a wave guide, the wave guide being shaped to focus the radio frequency energy emitted from the first radio frequency energy emitting antenna to a specified effective nip width.

12. The apparatus of claim 9, further comprising a second radio frequency antenna, the first and second antennae being arranged on opposing sides of the print medium and providing an electromagnetic field thereacross.

13. A method of fusing toner to a print medium comprising the step of:

passing the print medium by a radio frequency antenna and imparting electromagnetic energy to the toner on the print medium;

wherein the radio frequency antenna is oscillating within 1 MHz of the natural frequency of the toner.

14. The method of claim 13, wherein the electromagnetic energy imparted to the print medium is sufficient to raise the temperature of the toner to the toner melting point.

15. A method of fusing toner to a print medium comprising the step of:

passing the print medium by a radio frequency antenna and imparting electromagnetic energy to the toner on the print medium;

wherein the radio frequency antenna is oscillating within 20% of a natural frequency of the toner.

16. The method of claim 15, wherein the radio frequency antenna is oscillating within 10% of the natural frequency of the toner.

17. The method of claim 15, wherein the electromagnetic energy imparted to the print medium is sufficient to raise the temperature of the toner to the toner melting point.

18. A printing apparatus comprising:

at least one photoconductive drum;

at least one laser optic system for tracing an image on the at least one photoconductive drum;

a toner supply electrically charged opposite of the image traced on the at least one photoconductive drum;

a first radio frequency antenna for imparting electromagnetic energy to a toner; and a second radio frequency antenna, the first and second antennae being arranged on opposing sides of a print medium and providing an electromagnetic field thereacross.

19. The printing apparatus of claim 18, wherein radio frequency energy from the radio frequency antennae has a frequency within 20% of a natural frequency of the toner.

20. The printing apparatus of claim 19, wherein radio frequency energy from the radio frequency antennae has a frequency within 10% of a natural frequency of the toner.

21. A method of printing an image on a page by an electrophotographic process comprising the steps of:

cleaning at least one organic photoconductive (OPC) drum;

conditioning the at least one OPC drum to accept an image from a laser;

writing a latent image on the at least one OPC drum with a laser beam;

developing the latent image into a toner image by attracting toner to the at least one OPC drum;

transferring the toner to the page; and fusing the toner to the page by applying pressure and radio frequency energy to the toner, wherein said fusing is performed with a pressure roller which incorporates a radio frequency antenna for emitting said radio frequency energy onto the toner.

22. The method of claim 21, wherein the radio frequency energy is sufficient to raise the temperature of the toner to the melting point of the toner.

23. An apparatus comprising:

a print medium transport system for transporting print media bearing toner images; and a pressure roller for pressing a toner image on a print medium, said pressure roller comprising a first radio frequency energy emitting antenna for emitting radio frequency energy to fuse the toner image to the print medium;

wherein said transport system is configured to transport print media bearing toner images past said pressure roller to fuse the toner image to the print medium.

24. The apparatus of claim 23, further comprising a second pressure roller comprising a second radio frequency energy emitting antenna, wherein said transport system is configured to transport print media between said first and second pressure rollers.

25. The printing apparatus of claim 24, wherein radio frequency energy from the radio frequency energy emitting antennae has a frequency within 20% of a natural frequency of the toner.

26. The printing apparatus of claim 25, wherein radio frequency energy from the radio frequency energy emitting antennae has a frequency within 10% of a natural frequency of the toner.

* * * * *